US011913313B2

(12) United States Patent
Albert

(10) Patent No.: US 11,913,313 B2
(45) Date of Patent: Feb. 27, 2024

(54) ADAPTERS FOR DRILLED, UNCOMPLETED WELLS

(71) Applicant: Bestway Oilfield, Inc., Channelview, TX (US)

(72) Inventor: Mark D. Albert, San Leon, TX (US)

(73) Assignee: Bestway Oilfield, Inc., Channelview, TX (US)

( * ) Notice: Subject to any disclaimer, the term of this patent is extended or adjusted under 35 U.S.C. 154(b) by 0 days.

(21) Appl. No.: 17/503,171

(22) Filed: Oct. 15, 2021

(65) Prior Publication Data

US 2022/0120167 A1 Apr. 21, 2022

Related U.S. Application Data

(60) Provisional application No. 63/092,021, filed on Oct. 15, 2020.

(51) Int. Cl.

| | |
|---|---|
| ***E21B 43/26*** | (2006.01) |
| ***E21B 1/04*** | (2006.01) |
| ***E21B 33/04*** | (2006.01) |
| ***E21B 34/06*** | (2006.01) |

(52) U.S. Cl.

CPC ..... *E21B 43/26* (2013.01); *E21B 1/04* (2013.01); *E21B 33/04* (2013.01); *E21B 34/06* (2013.01)

(58) Field of Classification Search

CPC ..... E21B 43/26; E21B 17/04; E21B 33/04; E21B 34/06

USPC ..... 166/308.1

See application file for complete search history.

(56) References Cited

U.S. PATENT DOCUMENTS

| | | | | |
|---|---|---|---|---|
| 3,965,987 | A | 6/1976 | Biffle | |
| 4,390,186 | A | 6/1983 | Mcgee et al. | |
| 4,440,404 | A | 4/1984 | Roach et al. | |
| 4,652,022 | A | 3/1987 | Nichols | |
| 4,823,882 | A | 4/1989 | Stokley et al. | |
| 5,205,356 | A * | 4/1993 | Bridges | E21B 33/03 166/85.1 |
| 5,394,943 | A * | 3/1995 | Harrington | E21B 33/04 166/373 |
| 5,540,282 | A * | 7/1996 | Dallas | E21B 33/03 166/88.1 |
| 5,743,335 | A | 4/1998 | Bussear | |
| 6,360,822 | B1 | 3/2002 | Robertson | |
| 6,364,024 | B1 * | 4/2002 | Dallas | E21B 33/068 166/85.4 |
| 7,069,987 | B2 | 7/2006 | Kwasniewski et al. | |

(Continued)

FOREIGN PATENT DOCUMENTS

CA 2638434 A1 1/2010

*Primary Examiner* — Matthew R Buck
*Assistant Examiner* — Patrick F Lambe
(74) *Attorney, Agent, or Firm* — Johnston IP Law, PLLC

(57) ABSTRACT

In one instance, a method of completing a well includes providing a drilling-uncompleted adapter having a first side on an upper portion and a second side on a lower portion and attaching the second side of the drilling-uncompleted adapter onto a casing head of a well. The method further includes attaching at least one fracturing valve to the first side of the drilling-uncompleted adapter and fracturing the well. The method also includes removing the drilling-uncompleted adapter after fracturing and attaching tubing head to the casing head for production. The tubing head does not endure the fracturing.

6 Claims, 8 Drawing Sheets

(56) References Cited

U.S. PATENT DOCUMENTS

| | | | | |
|---|---|---|---|---|
| 7,140,445 | B2 | 11/2006 | Shahin et al. | |
| 7,308,934 | B2 | 12/2007 | Swagerty et al. | |
| 7,311,148 | B2 | 12/2007 | Giroux et al. | |
| 7,614,448 | B2 * | 11/2009 | Swagerty | E21B 43/26 166/177.5 |
| 8,327,943 | B2 | 12/2012 | Borak et al. | |
| 8,950,485 | B2 * | 2/2015 | Wilkins | E21B 43/26 166/308.1 |
| 10,494,898 | B2 | 12/2019 | Kajaria et al. | |
| 10,895,139 | B2 * | 1/2021 | Sizemore | E21B 43/2607 |
| 11,149,513 | B2 | 10/2021 | Scott | |
| 11,746,632 | B2 | 9/2023 | Scott | |
| 2011/0083852 | A1 * | 4/2011 | Bertrand | E21B 33/02 166/308.1 |
| 2011/0108275 | A1 * | 5/2011 | Borak | E21B 33/037 166/308.1 |
| 2012/0012341 | A1 | 1/2012 | White et al. | |
| 2015/0315869 | A1 | 11/2015 | Landry et al. | |

* cited by examiner

ADAPTERS FOR DRILLED, UNCOMPLETED WELLS

CROSS-REFERENCE TO RELATED APPLICATION

This application claims the benefit of U.S. Provisional Application Ser. No. 63/092,021, filed by Mark D. Albert, on Oct. 15, 2020, entitled "Adapters for Drilled, Uncompleted Wells," which is incorporated herein by reference in its entirety for all purposes.

TECHNICAL FIELD

This application is directed, in general, to oil and gas applications, and more specifically, to hydraulic fracturing, and more particularly still to adapters for drilled, uncompleted wells.

BACKGROUND

Oil and gas provide much of the energy used for transportation in the world today. As oil and gas resources become rarer, newer techniques are being used to further develop these resources. Hydraulic fracturing is one example. It is a technique that assists in reaching what has previously been difficult-to-reach sources of oil and gas. While in existence from the 1940s, hydraulic fracturing (or "fracking" or "fracing") has only become common place in the United States and other locations in more recent times.

At a high level, hydraulic fracturing enhances production from a well by creating man-made fractures in rock formations to facilitate oil and gas removal. The fracturing process typically involves injecting a fracturing fluid, e.g., sand, water, and certain chemicals, into the well under pressure to form the man-made fractures. The man-made fractures or larger fissures allow more oil and gas to flow out of formations and into the wellbore. The oil and gas can be readily extracted from the wellbore.

The fracking is done at a significantly higher pressure than the static reservoir pressure. The production fluid normally has a pressure that is not very high at the wellhead. During the fracking procedure, the pressures can be high, e.g., 5000 PSI or even as high as 10,000 PSI or higher.

SUMMARY

According to an illustrative embodiment, a method of preparing a well for production includes providing a drilling-uncompleted adapter having a first side on an upper portion and a second side on a lower portion and attaching the second side of the drilling-uncompleted adapter onto a casing head of a well. The method further includes attaching at least one fracturing valve to the first side of the drilling-uncompleted adapter and fracturing the well. The method also includes removing the drilling-uncompleted adapter and attaching tubing head to the casing head for production.

According to an illustrative embodiment, a fracturing assembly for use on an oil well includes a casing head having a first flange on an upper side and a drilling-uncompleted adapter having a first side on an upper side and a second side on a lower side. The drilling-uncompleted adapter has an inner annulus with an upper portion and a lower portion. The fracturing assembly also includes a casing hanger or casing disposed at least partially in the inner annulus of the drilling-uncompleted adapter forming a sealing chamber, and an energizeable seal disposed within the sealing chamber. The fracturing assembly also includes an injection port on the drilling-uncompleted adapter with a conduit from the injection port to the inner annulus proximate the sealing chamber to provide an energizing, pressurized fluid during fracturing operations.

According to an illustrative embodiment, a method of preparing a well for production includes providing a drilling-uncompleted adapter having a first side on an upper portion and a second side on a lower portion. The drilling-uncompleted adapter includes a body having an inner annulus and having at least one injection port, which has a conduit from the injection port to a sealing chamber formed at a portion of the inner annulus, whereby a seal may be energized during fracturing. The drilling-uncompleted is valve free. The method further includes attaching the second side of the drilling-uncompleted adapter onto a casing head of a well and attaching at least one fracturing valve to the first side of the drilling-uncompleted adapter. The method also includes fracturing the well, removing the drilling-uncompleted adapter, and attaching a tubing head to the casing head for production. Other illustrative embodiments are included herein.

DESCRIPTION OF THE DRAWINGS

Illustrative embodiments of the present disclosure are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Unless otherwise indicated, as used throughout this document, "or" does not require mutual exclusivity.

Figure 1:
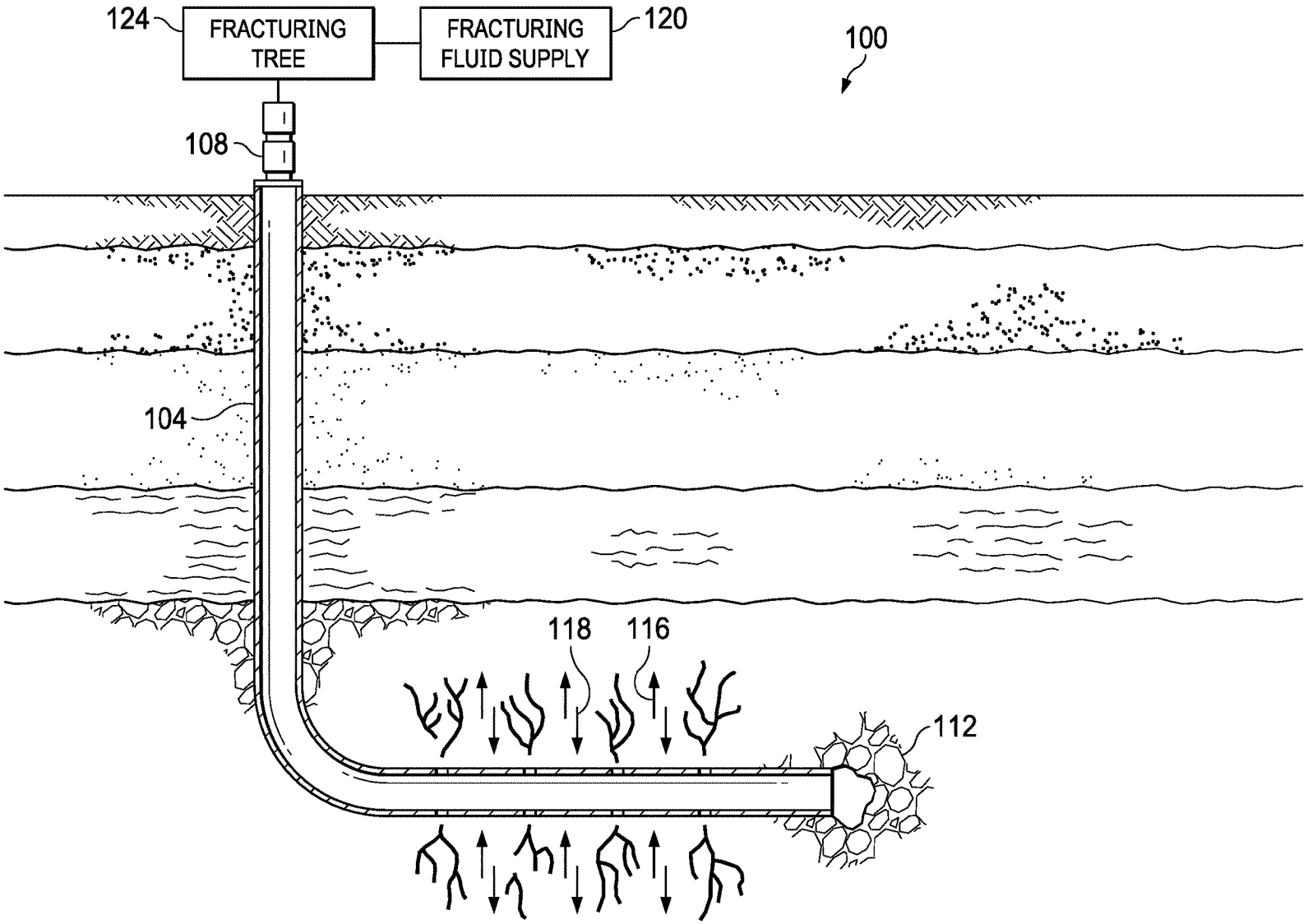
FIG. 1 is a schematic diagram that illustrates a hydraulic fracturing system at a well site shown with the above-ground portion shown in block diagrams and the subterranean portion shown in cross section.

After the initial drilling process is finished, a completion process is undertaken. As an aspect of that process, the well may be stimulated by hydraulic fracturing, or fracking. Referring now to the figures, and initially to FIG. 1, a diagram of a hydraulic fracturing system 100 is presented with a subterranean portion shown in cross section and the above ground portions shown as a schematic block diagram. The well 104 extends from the wellhead 108 and into a subterranean strata or formation 112 from which natural resources, e.g., oil and gas, are removed. The removal of natural resources is enabled or enhanced by the hydraulic fracturing system 100.

The hydraulic fracturing system 100 injects fracturing fluid into the well 104 and into the formation 112. The flow of the fracturing fluid 116 into the formation 112 increases the number or size of fractures in a rock formation of the formation 112 to enhance flow of resources 118 in the well 104. To do this, a fracturing fluid supply 120 is delivered through a fracturing tree 124 at the well head to the well 104.

In order to fracture a well, one typically fractures the formation with a much higher pressure than the pressure with which the well is produced. In recent times it has been done by attaching a tubing head assembly, or tubing head, that users have put on a well and this is used in the completion process. In order to perform the fracturing through the tubing head, however, the tubing head has to endure much higher pressures than for production. As one illustrative example, production might be at a pressure of approximately 5,000 PSI for the working pressure, but it might have to be 15,000 PSI working pressure for fracturing.

In order to have the tubing head assembly sized for the fracturing operation, the operators have to spend additional money for the higher-pressure tubing that really acts as a fracturing spool. The tubing head on the well is engineered for the higher pressures experienced in fracturing. In addition, with the approach that has been used, the tubing head has been exposed to all the harsh conditions of the fracturing and at least at times that may cause damage to the tubing head. In some circumstances, the tubing head may not be usable later in the process when one gets ready to complete the well.

According to an illustrative embodiment of the present disclosure, systems, devices, and methods are presented that allow a tubing head to be used that does not have to endure the fracturing pressures. An illustrative drilling-uncompleted adapter, or DUC adapter 220 (FIG. 4), is used for this purpose. The drilling-uncompleted adapter is a bridge that one is able to be put on for fracturing the well to get the well ready for production and then one can put on a production tubing head after that. In this way, the production tubing head does not endure the fracturing process.

Figure 2:
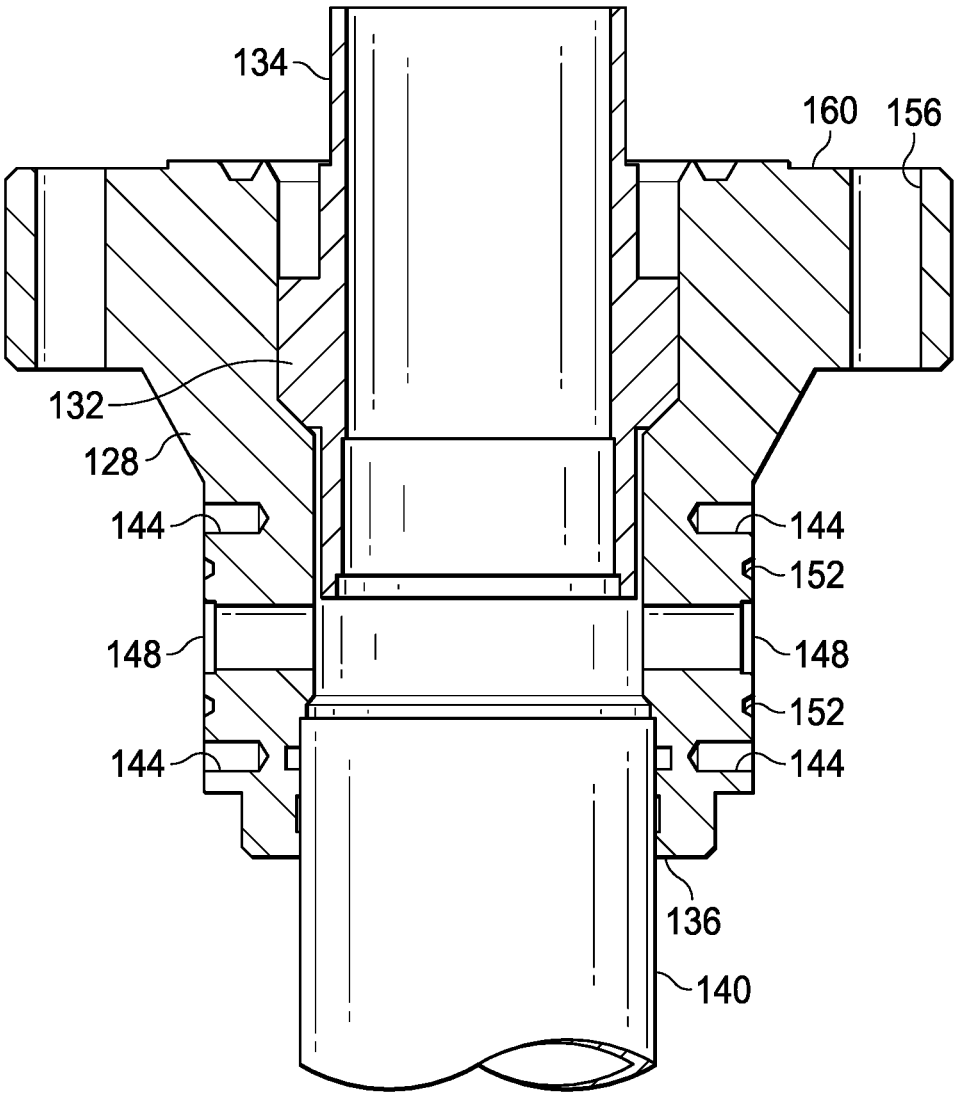
FIG. 2 is a schematic cross section at a well head showing a casing head and casing hanger.

Referring now primarily to FIG. 2, a portion of the wellhead 108 is shown that features a casing head 128 (or lower wellhead housing or spool). As used through this application and the claims, the term "casing head" is meant broadly and includes a casing spool. A mandrel casing hanger 132, or casing slip, is shown against a portion of the casing head 128. The casing hanger 132 has an upper portion 134. The casing hanger 132 suspends the heavy metal casing inside the well. The casing hanger 132 provides support for the casing string when it is lowered into, or run, into the wellbore. It serves to ensure that the casing is properly located and helps with sealing. A lower portion 136 of the casing head 128 is shown attached to a surface casing 140. The casing head 128 has stud foundation apertures/receptacles 144 for securing equipment over outlets or ports 148. Seal grooves 152 are also included. Bolt holes 156 extend through a flange portion 160.

Figure 3:
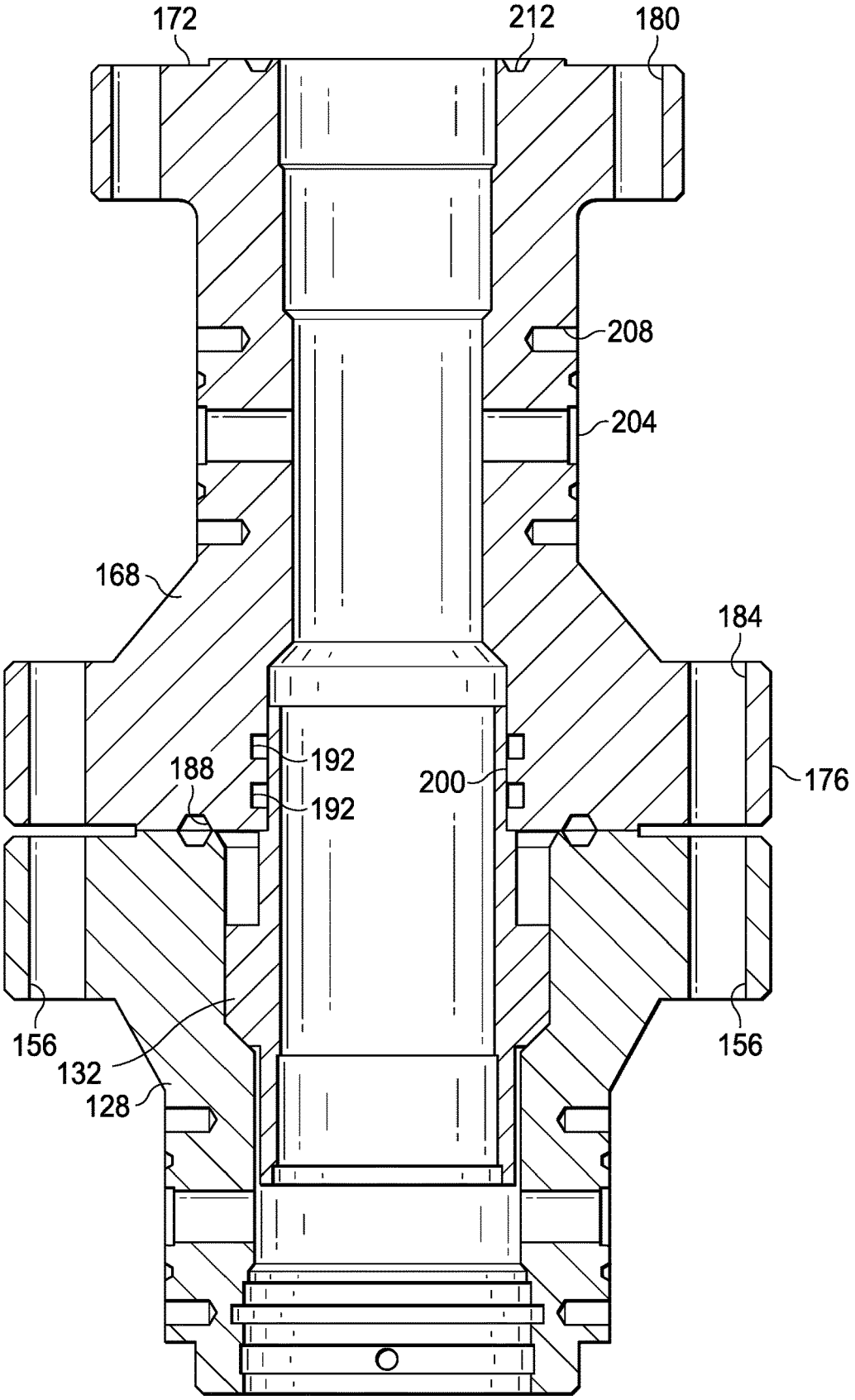
FIG. 3 is a schematic cross section at a well head showing a casing head with a tubing head applied.

Referring now primarily to FIG. 3, a tubing head 168 is shown on top of the casing head 128. According on an illustrative embodiment, after drilling the well, the drilling-uncompleted adapter 220 (FIG. 5), or drilled uncomplete adapter, is attached to the casing head 128 and the well is fractured. Afterwards, the tubing head 168 is coupled to the casing head 128. In this way, the tubing head 168 does not have to endure the environment or wear associated with being in place on the well during fracturing. In older techniques, the tubing head 168 was kept in place during the fracturing in the arrangement shown and, thus, had to be designed for the pressures realized during fracturing as well as the wear and tear.

In this example, the tubing head 168 includes a first, or upper, flange 172 and second, or lower, flange 176. The first flange 172 has bolt holes or apertures 180, and the second flange 176 has bolt holes or apertures 184. The second flange 176 mates with the first flange 160 of the casing head 128, and a bolt (not shown) runs through bolt holes 184, 156. The tubing head 168 may include ring gasket groove 188 on the second flange 176 and a plurality of ring gasket grooves 192 on an inner annulus 200. The tubing head 168 may include studded outlets 204 with associated stud receptacles 208. The first flange 172 may also include one or more ring gasket grooves 212. Other variations may be made, but this shows one embodiment of application of the tubing head 168 after fracturing.

Figure 4:
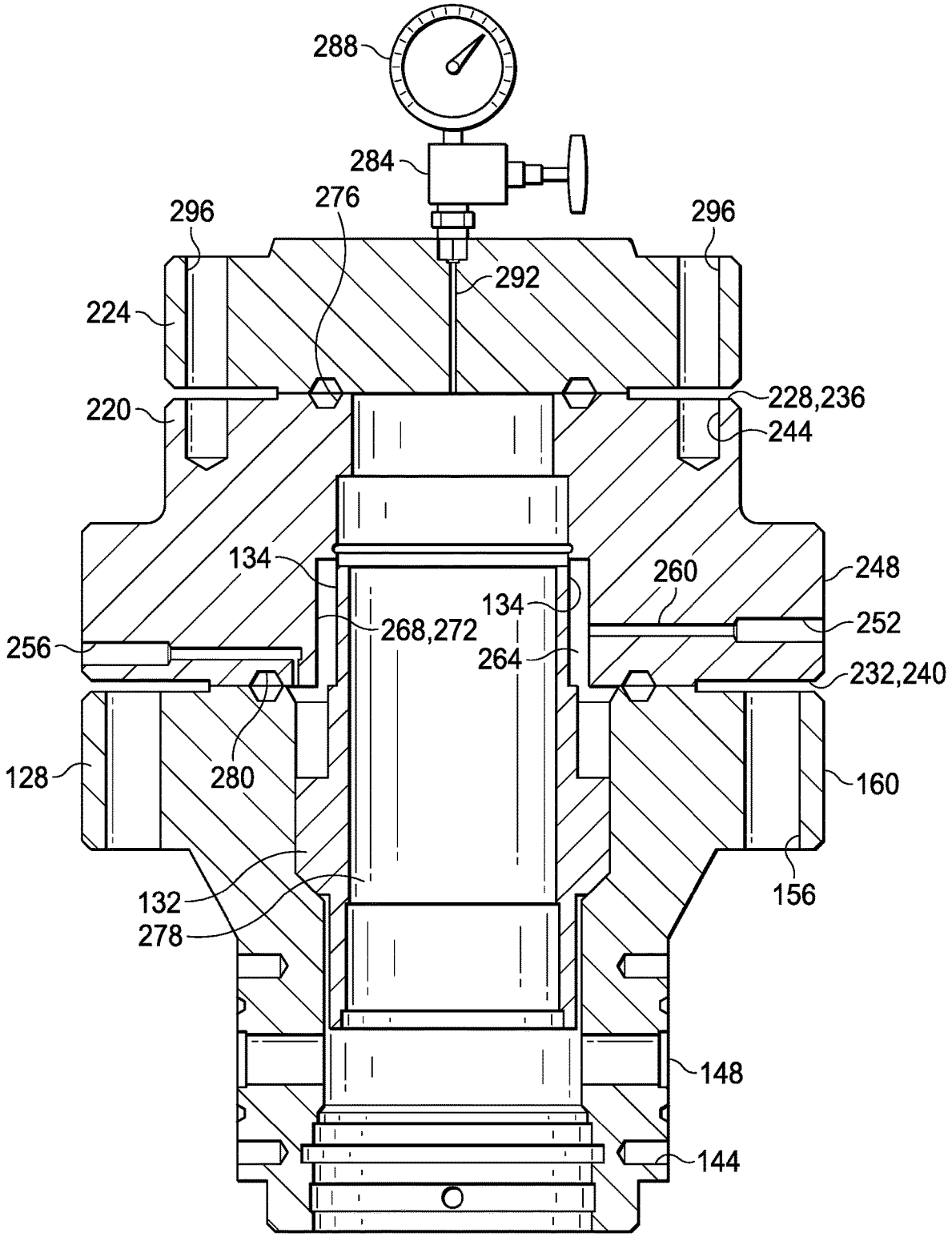
FIG. 4 is a schematic cross section at a well head showing a casing head with a drilling-uncompleted adapter and test flange applied.

Referring now primarily to FIG. 4, an illustrative embodiment of a drilling-uncomplete adapter 220 is shown installed on top of the casing head 128 and a test flange 224, or capping flange, on top of the drilling-uncomplete adapter 220. The drilling-uncomplete adapter 220 has first, or upper or upper, side 228 and a second, or lower or lower, side 232. The first side 228 has a first flange 236, and the second side 232 has a second flange 240. The first flange 236 is shown with stud receptacles 244, but the studs (see 308 in FIG. 6) have been removed for clarity. Moreover, the studs (312 in FIG. 6) that extend from the second flange 240 have been removed for clarity as well but would extend into the bolt holes 156 from stud receptacles (324 in FIG. 7) in the second flange 240. The first flange 236 is smaller than the second flange 240.

An outer periphery 248 may have one or more ports, e.g., injection port 252 and test port 256. One or more injection ports 252 may be on the periphery 248 and fluidly couple with a conduit 260 that provides fluid communication to a sealing chamber 264 formed proximate the upper portion 134 of the casing hanger 132 or casing and a portion 268 of an inner annulus 272 formed in a body of the drilling-uncomplete adapter 220. The first flange 236 may have one or more ring gasket grooves 276, and likewise the second flange 240 may have one or more ring gasket grooves 280. The inner annulus 272 may have steps or shoulders in the annulus. The production casing 278 extends into the inner annulus 272.

During fracturing operations, an energizing, pressurized fluid may be pumped through the one or more injection ports 252 through conduit 260 into the sealing chamber 264 to energize a seal (not shown) therein. The lower sealing chamber 264 is shown, but it should be understood that another analogous sealing chamber may be available on an upper portion of the inner annulus 272 as well.

After drilling, the drilling-uncomplete adapter 220 adapter may be applied to the first side of the casing head 128, and the test flange 224 may be coupled to the first side 228 of the drilling-uncomplete adapter 220. The test flange 224 is a capping type of arrangement that gives the operator an option to monitor pressure as suggested by a needle valve 284 and a pressure gauge 288. A pressure check and check of the seals may be done with the needle valve 284 and the pressure gauge 288 that are fluidly coupled to an access port or conduit 292. The test flange 224 may be formed with bolt holes or apertures 296 through it to receive studs extending from the stud receptacle 244 of the drilling-uncomplete adapter 220. The test flange 224 may remain in place—like an abandonment cap—until completion of the well is desired. When completion is desired, the test flange 224 may be removed and a fracturing valve applied as shown in FIG. 5.

Figure 5:
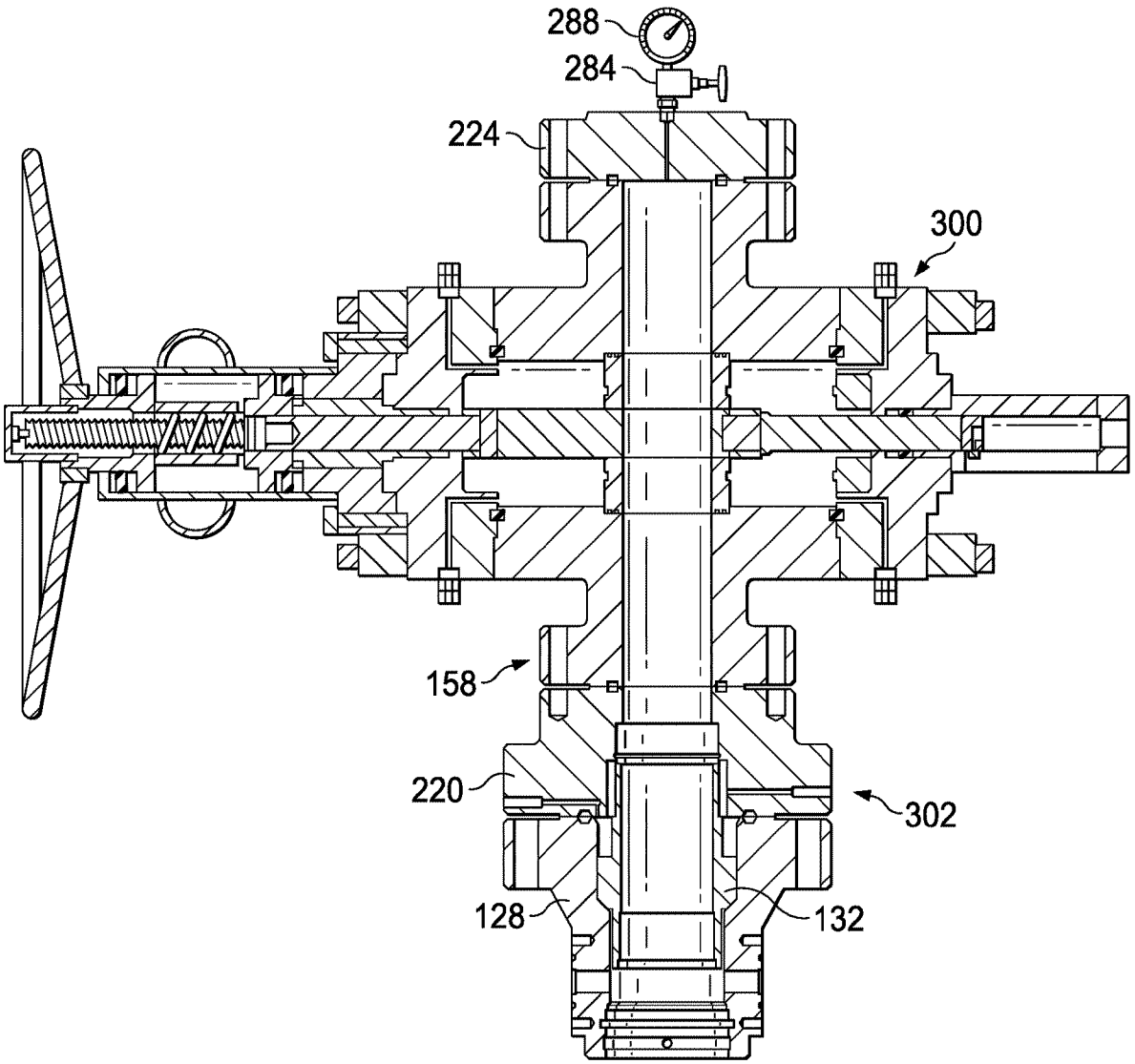
FIG. 5 is a schematic cross section at a well head showing a casing head with a drilling-uncompleted adapter and fracturing valve applied.

Referring now primarily to FIG. 5, when fracturing is desired, the test flange 224 is removed and a fracturing valve assembly 300 is applied onto the first side 228 of the drilling-uncomplete adapter 220. The tubing head 168 (FIG. 3) is not installed during fracturing and accordingly need withstand the fracturing environment. The test flange 224 may be applied on a first side or top side of the fracturing assembly 300 as shown. At this point the operator has vertical access to the wellbore and has a mechanism to open and close so as to fracture the well. Note again that this allows the fracturing to be accomplished without a tubing head applied.

Because the tubing head 168 (FIG. 3) is not installed during fracturing, the tubing head 168 may be rated for a much lower pressure while the drilling-uncomplete adapter 220 must be rated to withstand the fracturing pressures. In some embodiments, the drilling-uncomplete adapter 220 is sized and configured to withstand pressures 6,000 PSI and higher. In some embodiments, the drilling-uncomplete adapter 220 is sized and configured to withstand pressures 7,000 PSI and higher. In some embodiments, the drilling-uncomplete adapter 220 is sized and configured to withstand pressures 8,000 PSI and higher. In some embodiments, the drilling-uncomplete adapter 220 is sized and configured to withstand pressures 9,000 PSI and higher. In some embodiments, the drilling-uncomplete adapter 220 is sized and configured to withstand pressures 10,000 PSI and higher. Other pressures may be used. At the same time, in some embodiments, the tubing head 168 may be sized and configured to operate at and below 5,500 PSI. In some embodiments, the tubing head 168 may be sized and configured to operate at and below 6,000 PSI. In some embodiments, the tubing head 168 may be sized and configured to operate at and below 7,000 PSI. Other pressures may be used. In some embodiments, a maximum pressure rating of the drilling-uncompleted adapter 220 is at least twice that of the tubing head 168. In some embodiments, a maximum pressure rating of the drilling-uncompleted adapter 220 is at least three times that of the tubing head 168.

After fracturing, the operator can fracture, flow the well back, and can produce the well until the operator gets to a point where reservoir virgin pressure is realized. The reservoir virgin pressure is whatever the reservoir is going to balance out at, i.e., static field pressure. When the operator is ready to actually run tubing inside in the production casing, the operator will apply the tubing head 168 for completion as shown in FIG. 3.

Because the tubing head 168 is not present for fracturing, there is no longer a need to have the tubing head 168 rated for the higher pressure of fracturing, but only for the static field pressure. That may result in a cost savings. In addition, the tubing head 168 remains pristine and does not experience all the harsh environment of fracturing and flowing the well back because those operations are being done through the drilling-uncomplete adapter 220.

Moreover, in the past, when operators drilled wells that were not going to be completed at that time, the wells were left uncompleted and dormant. In such situations, in order to have a valve on the well, the operators were buying the tubing head and letting the tubing heads sit in place there for years. Some of the tubing heads would leak when finally used. With the present disclosure, the operators could put a drilling-uncomplete adapter 220 on the casing head and the drilling-uncomplete adapter 220 would bridge between fracturing and the completion.

Referring primarily to FIGS. 2, 4, and 5, according to an illustrative embodiment, a fracturing assembly 302 for use on an oil well includes a casing head 128 having a first flange 160 on an upper side and a drilling-uncompleted adapter 220 having a first side 228 on an upper side and a second side 232 on a lower side. The drilling-uncompleted adapter 220 has an inner annulus 272 with an upper portion and a lower portion. The fracturing assembly 302 also includes a casing hanger 132 or casing disposed at least partially in the inner annulus 272 of the drilling-uncompleted adapter 220 forming a sealing chamber 264, and an energizeable seal disposed within the sealing chamber 264. The energizeable seal is an annular member that passes all the way around the sealing chamber 364 and is activated by a sealing pressure being applied. In one illustrative embodiment, the seal was a 93-360-00A (P-SEAL, 7⅝", CIW, with retaining wires (2)). The seals slipover the casing and then is activated using the injection ports—plastic injected. The fracturing assembly 302 also includes the injection port 252 on the drilling-uncompleted adapter 220 with a conduit 260 from the injection port 252 to the inner annulus 272 proximate the sealing chamber 264 to provide an energizing, pressurized fluid during fracturing operations or other operations requiring a seal. The sealing chamber 264 has the top portion of the casing hanger or casing itself on an inside portion and the annulus on the other side with the seal in between.

Figure 6:
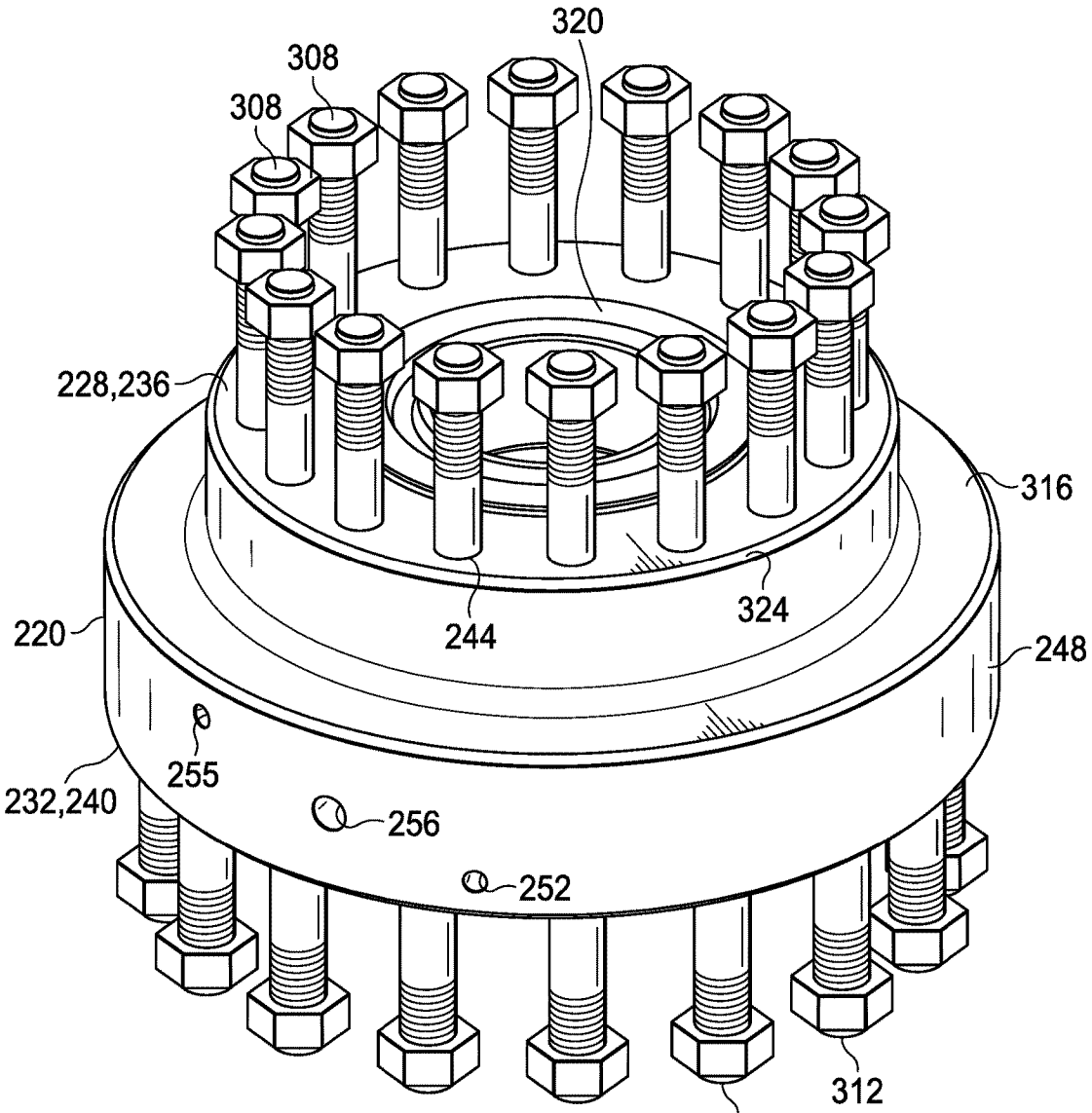
FIG. 6 is a schematic perspective view of an illustrative embodiment of a drilling-uncompleted adapter.
Figure 7:
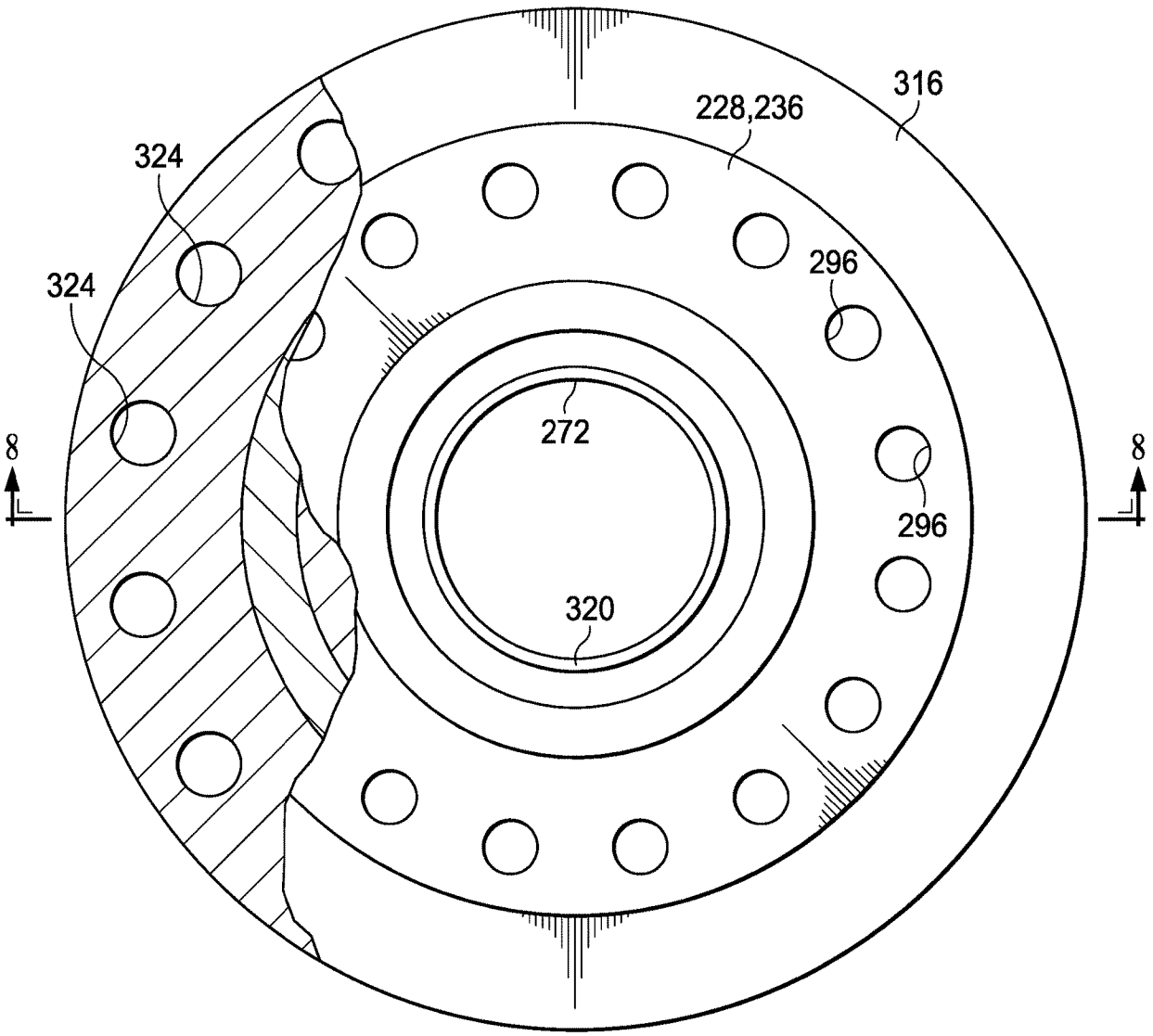
FIG. 7 is a schematic plan view with a portion broken away of an illustrative embodiment of a drilling-uncompleted adapter.
Figure 8:
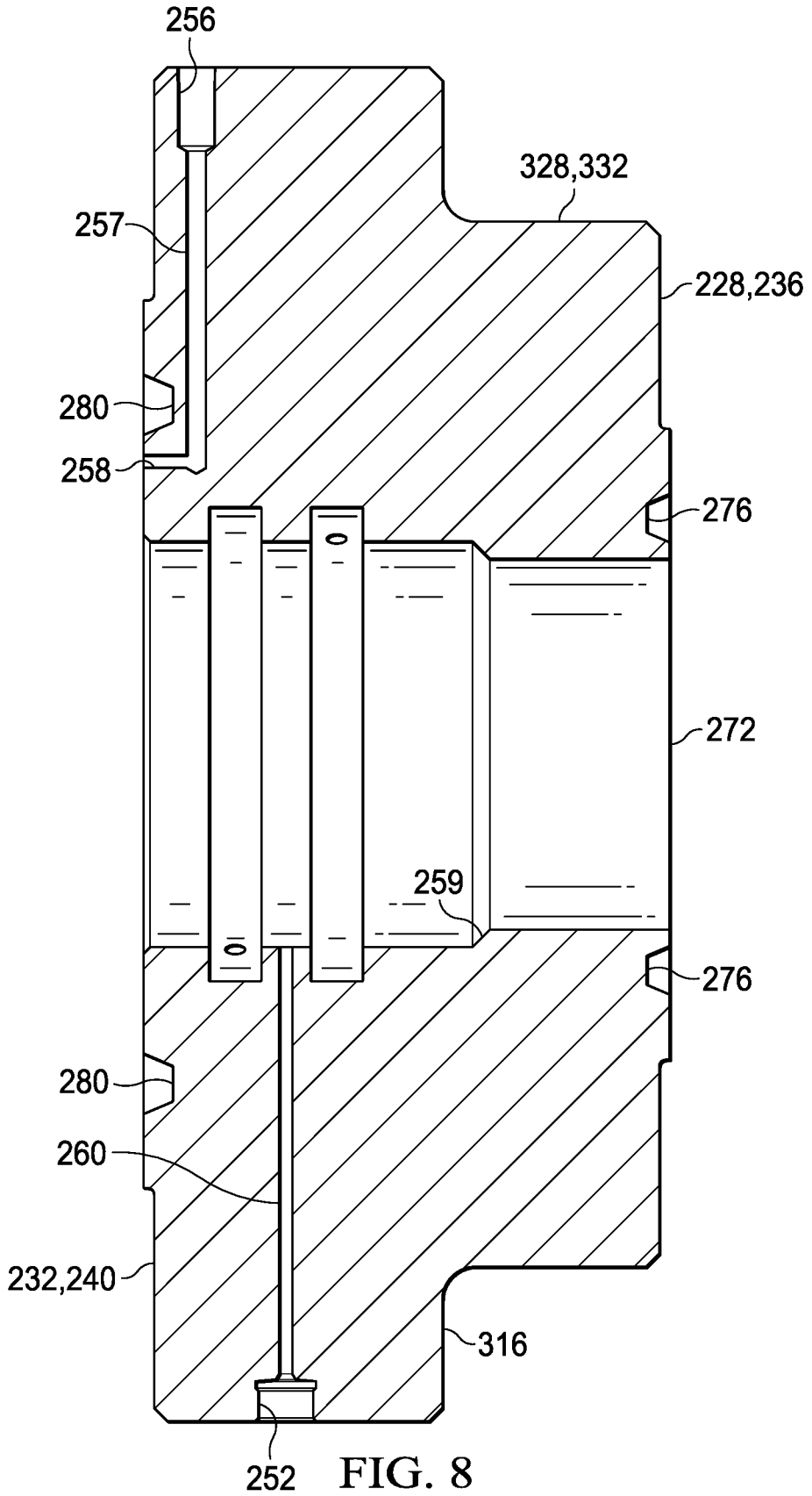
FIG. 8 is a schematic cross section of the illustrative embodiment of a drilling-uncompleted adapter of FIG. 7 taken along line 8-8.

Referring now primarily to FIGS. 6-8, the drilling-uncomplete adapter 220 is shown in various views. FIG. 6 shows a perspective view with a first plurality of studs 308 extending from the stud receptacles 244 on the first flange 236. Likewise, a second plurality of studs 312 extend from the second flange 240 on the second side 232. An upper side of the second flange 240 presents a shelf 316. The inner annulus is shown beginning on the first side 228 with a beveled portion 320. The corners may be rounded as shown, for example, at 324. One may see on the periphery 248, a first injection port 252, a testing port 256, and a second injection port 255.

FIG. 7 shows a plan view (looking towards the first side 228) with a portion broken away. The broken away portion shows a plurality of stud receptacles 324 into which the second plurality of studs 312 are coupled.

As shown best in FIG. 8, the at least one test port 256 may have a conduit 257 that fluidly couples to an opening 258 on the second side 232. The inner annulus 272 may have one or more shoulders 259.

In some embodiments, the drilling-uncomplete adapter 220 comprises a solid, unitary member 328 formed with the inner annulus 272 and having at least one injection port 252 on the outer periphery 248, which has a conduit 260 from the injection port 252 to the sealing chamber 264 formed at a portion of the inner annulus 272, whereby a seal may be energized during fracturing or other times.

In some embodiments, the drilling-uncomplete adapter 220 comprises an adapter body 332 formed with the inner annulus 272 and having at least one injection port 252 on the outer periphery 248, which has a conduit 260 from the injection port 252 to the sealing chamber 264 formed at a portion of the inner annulus 272, whereby a seal may be energized during fracturing or other times.

In some embodiments, the drilling-uncomplete adapter 220 is formed as a solid, unitary member 328 or an adapter body 332 formed with the inner annulus 272 and having at least one injection port 252 on the outer periphery 248. In such an embodiment, the drilling-uncomplete adapter 220 is valve free and may be lock-screw free as well. The idea is to not have items that can be harmed by higher pressures. Indeed, the adapter 220 is like a bridge and allows one to get onto the well and fracture the well with higher pressures but without all the valves, lock screws, and items that are not needed at that time and may be damaged.

There may be many potential advantages to the illustrative drilling-uncomplete adapter 220 described and shown herein. For example, in the past, when an operator drilled a well and decided not to do anything at that time, the operator would put an abandonment cap on it. The abandonment caps used typically lacked pressure integrity. Now, the drilling-uncomplete adapter 220 can be used and has pressure integrity. Along with that, the drilling-uncomplete adapter 220 may allow one to pressure check the casing slips and seals before the drilling rig is removed. This stops communication with an underground blowout. If there is nothing above that casing to contain it, one cannot test it. The temporary abandonment caps did not allow testing, but the drilling-uncomplete adapter 220 does. One advantage may be having the drilling-uncompleted adapter serve in lieu of a temporary abandonment cap.

Another possible advantage may be that the drilling-uncomplete adapter 220 allows for casing slips and seals to be tested before the drilling rig is removed. Another advantage is that the drilling-uncomplete adapter 220 enables a well to be fractured and flowed back without requiring the tubing head to be installed. Another advantage may be that it eliminates wear and tear on the tubing head and reduces potential leak points. Another advantage may be that it lowers the overall cost and tubing head sized that is installed because it is after fracturing.

As another potential advantage, the drilling-uncomplete adapter 220 may be left in place without exposing a tubing head. One can keep the drilling-uncomplete adapter 220 in place all the way through completion. The drilling-uncomplete adapter 220 enables the well to be fractured and for flow back to occur without the tubing head installed. The drilling-uncomplete adapter 220 may also eliminate wear-and-tear on the tubing head and the concomitant potential leak points because the tubing head is not in place during any of fracturing or waiting. As already referenced, the drilling-uncomplete adapter 220 may allow for lower costs because the design point of the tubing head is for a much lower pressure, i.e., production pressure instead of fracturing pressure. The drilling-uncomplete adapter 220 may be repaired and redressed with minimal effort and reused. The drilling-uncomplete adapter 220 may be completed in standard or stainless-steel trim or x bushing depending on the gas environment in which the adapter is going to be used or in other metals.

According to an illustrative embodiment, a method of preparing a well for production includes providing a drilling-uncompleted adapter 220 having a first side 228 on an upper portion and a second side 232 on a lower portion; attaching the second side 232 of the drilling-uncompleted adapter 220 onto a casing head 128 of a well; attaching at least one fracturing valve 300 to the first side 228 of the drilling-uncompleted adapter 220; fracturing the well; removing the drilling-uncompleted adapter 220; and attaching tubing head 168 to the casing head 128 for production.

According to an illustrative embodiment, a method of preparing a well for production includes providing a drilling-uncompleted adapter 220 having a first side 228 on an upper portion and a second side 232 on a lower portion; attaching the second side 232 of the drilling-uncompleted adapter 220 onto a casing head 128 of a well; attaching a testing flange 224 on the first side 228 of the drilling-uncompleted adapter 220 until ready for a tubing head 168; removing the testing flange 224; attaching at least one fracturing valve 300 to the first side 228 of the drilling-uncompleted adapter 220; fracturing the well; removing the drilling-uncompleted adapter 220; and attaching tubing head 168 to the casing head 128 for production.

According to an illustrative embodiment, a method of preparing a well for production comprises attaching a drilling-uncomplete adapter 220 onto a casing head 128 of a well; attaching at least one fracturing valve 300 to the drilling-uncomplete adapter 220; fracturing the well; removing the drilling-uncomplete adapter 220; and attaching tubing head 168 to the casing head 128 for production.

According to an illustrative embodiment, a method of preparing a well 104 for production includes providing a drilling-uncompleted adapter 220 having a first side 228 on an upper portion and a second side 232 on a lower portion. The drilling-uncompleted adapter 220 includes a body 332 having an inner annulus 272 and having at least one injection port 252, which has a conduit 260 from the injection port 252 to a sealing chamber 262 formed at a portion of the inner annulus 272, whereby a seal may be energized during fracturing. The drilling-uncompleted is valve free. The method further includes attaching the second side 232 of the drilling-uncompleted adapter 220 onto a casing head 132 of the well 104 and attaching at least one fracturing valve 300 to the first side of the drilling-uncompleted adapter 220. The method also includes fracturing the well, removing the drilling-uncompleted adapter 220, and attaching a tubing head 168 to the casing head 132 for production.

According to an illustrative embodiment, a drilling-uncomplete adapter 220 comprises a formed metal member sized and configured to interface at one end with a casing head 128 proximate the casing hanger 132 and at the other end to couple with a test flange 224 or fracturing valve 300.

According to one illustrative embodiment, the drilling-uncomplete adapter 220 is sized as a 11-10M×7 1/16—15M; that is an 11 inch API flange on one end for 10,000 PSI and a 7 1/16 bore flange on the other for 15,000 PSI. Those skilled in the art will understand there are many options and sizes, and this is just one illustrative example.

According to one illustrative embodiment, the drilling-uncomplete adapter 220 was sized as follows: The outer diameter of the first flange was 16.5 inches and the outer diameter of the second flange was 25.75 inches. The inner annulus on the first side had a diameter of 5.125 inches and on the second side had a diameter of 9.38 inches because of step downs or shoulders. The longitudinal length (direction of flow) was 10 inches. This embodiment included two injection ports 252—an upper one and a lower one. Another embodiment included six injection ports. The stud receptacles on the first side were drilled with outside diameter of 01.375 inches to a depth of 2 inches. The stud receptacles on the second side were drilled with an outside diameter of 1.625 inches to a depth of 2.25 inches. The spacing between the plurality of studs extending from the first and second sides was based on 22.5 degrees between adjacent studs. The studs on the first side were on a centerline diameter of 16.88 inches and the studs on the second side were on a centerline diameter of 22.25 inches. Those skilled in the art will understand that all the dimensions may be varied for different applications of the equipment.

As used herein, the term "coupled" includes coupling via a separate object and includes direct coupling. The term "coupled" also encompasses two or more components that are continuous with one another by virtue of each of the components being formed from the same piece of material. Also, the term "coupled" may include in some contexts chemical, such as via a chemical bond, mechanical, thermal, or electrical coupling. Fluid coupling means that fluid may be in communication between the designated parts or locations.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A method of completing a well comprising:

providing a drilling-uncompleted adapter having a first side on an upper portion and a second side on a lower portion;

wherein the drilling-uncompleted adapter comprises:

a body having an inner annulus extending from the first side to the second side, the body having a first flange proximate the first side and a second flange proximate the second side, wherein the first flange is smaller than the second flange, wherein the second flange is sized and configured to mate with a casing head, a shelf portion formed between the first flange and the second flange, a first plurality of studs extending from the first flange, a second plurality of studs extending from the second flange, and the body formed with at least one injection port on an outer periphery and formed with a conduit extending from the injection port to the inner annulus;

coupling the second side of the drilling-uncompleted adapter with the casing head of a well using the second plurality of studs;

coupling at least one fracturing valve to the first side of the drilling-uncompleted adapter using the first plurality of studs;

fracturing the well; and after fracturing the well and while keeping the drilling-uncompleted adapter in place, attaching a tubing head to the first side of the drilling-uncompleted adapter for production.

2. The method of claim 1, wherein coupling the second side of the drilling-uncompleted adapter onto the casing head comprises disposing the second plurality of studs through a plurality of bolt holes in the cashing head without coupling to a mandrel casing hanger.

3. The method of claim 1, wherein the drilling-uncompleted adapter comprises a sealing chamber formed on a portion of the inner annulus, wherein the conduit fluidly connects the injection port to the sealing chamber, and whereby a seal may be energized during fracturing.

4. The method of claim 1, wherein the drilling-uncompleted adapter comprises a sealing chamber formed on a portion of the inner annulus, wherein the conduit fluidly connects the injection port to the sealing chamber, and whereby an energizeable seal may be energized during fracturing; and wherein the drilling-uncompleted adapter is valve free.

5. The method of claim 1, wherein the drilling-uncompleted adapter comprises a sealing chamber formed on a portion of the inner annulus, wherein the conduit fluidly connects the injection port to the sealing chamber, and whereby an energizeable seal may be energized during fracturing; and wherein the drilling-uncompleted adapter is valve free and lock-screw free.

6. A method of completing a well comprising:

providing a drilling-uncompleted adapter having a first side on an upper portion and a second side on a lower portion;

wherein the drilling-uncompleted adapter comprises:

a body having an inner annulus extending from the first side to the second side, the body having a first flange proximate the first side and a second flange proximate the second side, wherein the first flange is smaller than the second flange, wherein the second flange is sized and configured to mate with a casing head, a shelf portion formed between the first flange and the second flange, and the body formed with at least one injection port on an outer periphery and formed with a conduit extending from the injection port to the inner annulus;

coupling the second side of the drilling-uncompleted adapter onto the casing head of a well;

coupling at least one fracturing valve to the first side of the drilling-uncompleted adapter;

fracturing the well; and after fracturing the well and while keeping the drilling-uncompleted adapter in place, attaching a tubing head to the first side of the drilling-uncompleted adapter for production.

* * * * *